United States Patent [19]

Reese

[11] 3,984,613

[45] Oct. 5, 1976

[54] ELECTRIC FURNACE WITH TILTABLE AND REMOVABLE HEARTH

[76] Inventor: Thurston F. Reese, 5905 Joymont St., Jackson, Mich. 49201

[22] Filed: May 19, 1975

[21] Appl. No.: 578,380

[52] U.S. Cl. ..... 13/10; 13/35; 266/240; 432/156; 432/262

[51] Int. Cl.[2] ..... F27B 14/02

[58] Field of Search ..... 13/10, 35; 266/43; 432/156, 157, 262, 264

[56] References Cited

UNITED STATES PATENTS

| | | | |
|---|---|---|---|
| 3,790,338 | 2/1974 | Duca | 432/157 X |
| 3,871,632 | 3/1975 | Wunsche | 13/10 X |

*Primary Examiner*—R. N. Envall, Jr.
*Attorney, Agent, or Firm*—Beaman & Beaman

[57] ABSTRACT

A direct arc electric furnace having a tiltable base for pouring molten metal from the furnace. A refractory lined hearth supported by the base is pivotal with respect to the base for tilting to a degree greater than that capable by the base. The furnace includes shell refractory lining material supported upon the hearth encompassed by a removable shell. Replacement of the shell lining is accomplished by removing the shell, collapsing the shell lining into the hearth, and tilting the hearth with respect to the base sufficiently to dump the collapsed lining from the hearth into the pit adjacent the furnace. Further, the use of the tilting and removable hearth permits the hearth to be removed from the base, inverted in the pit, and the refractory lining of the hearth may then be readily removed for replacement purposes.

12 Claims, 6 Drawing Figures

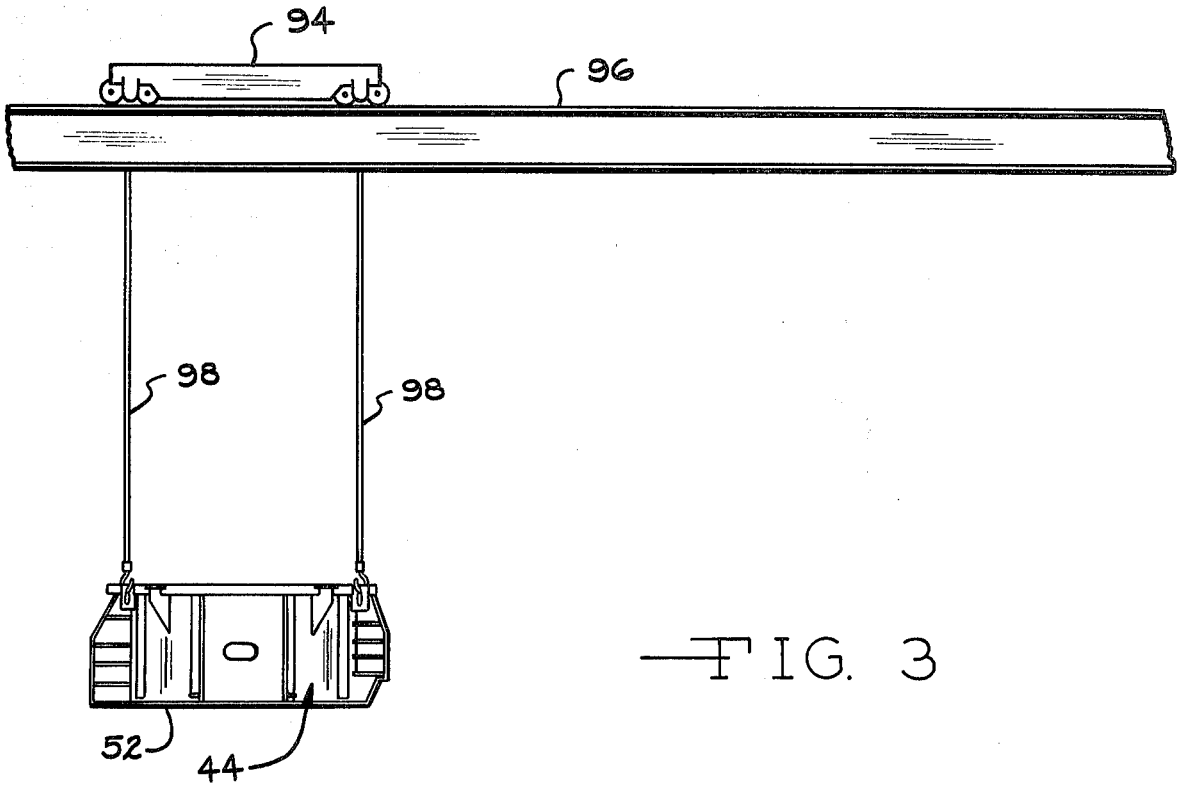
FIG. 3
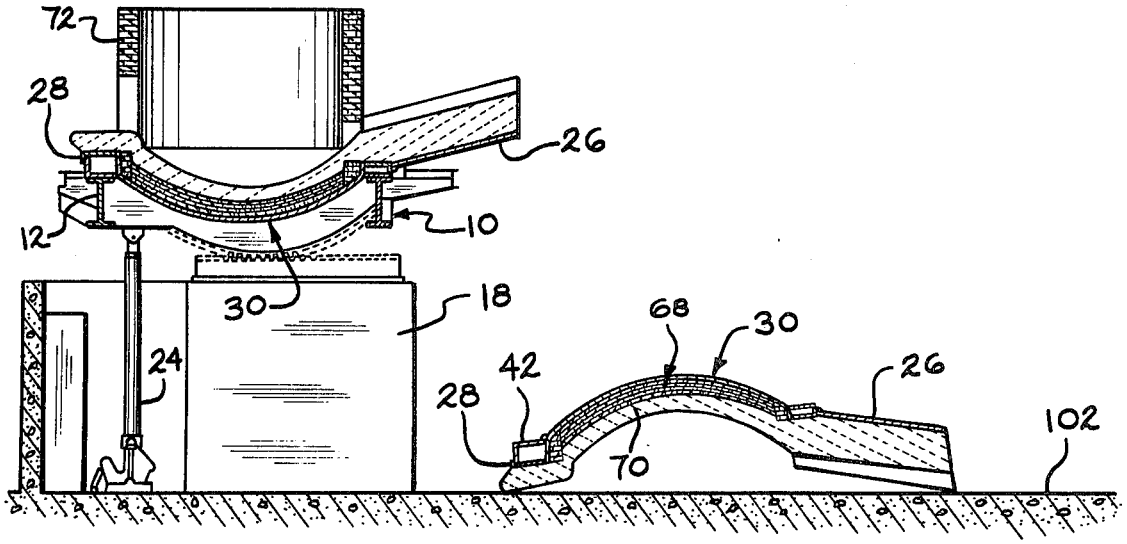

ELECTRIC FURNACE WITH TILTABLE AND REMOVABLE HEARTH

BACKGROUND OF THE INVENTION

The invention pertains to electric arc furnaces, and particularly pertains to a method and apparatus for readily removing deteriorated refractory lining from the furnace shell and hearth.

Direct arc electric furnaces include a base defining a hearth from which extends an annular wall or shell. The top of the furnace is closed by a removable cover through which the electrodes extend and the cover is removed from the shell during charging of the furnace. The hearth, shell and cover are internally protected from the molten metal by refractory lining material, and the furnace base is tiltable with respect to the horizontal whereby the molten metal therein may be poured from a pouring spout.

In a direct arc electric furnace it is necessary to periodically replace the refractory lining due to the destructive effect upon the lining by the arc and molten metal during furnace operation. The heat, molten metal, oxidation, and many other factors cause the refractory lining to be consumed and the lining must be periodically replaced. In particular, in a continuously operated furnace the shell lining wears especially rapidly and it is often necessary to replace the shell lining every four or five weeks. The hearth lining deteriorates much slower than the shell lining and may require replacement approximately once a year, while the lining in the cover may also be used for extended periods of time before requiring replacement.

With present direct arc electric furnace constructions the replacement of the refractory lining material, particularly the shell lining, is time consuming and expensive. The furnace must be emptied of molten metal, allowed to cool sufficiently to permit entry by the workmen, and the workmen manually, and with power tools, break away the refractory lining for removal from the furnace. After the lining has been removed rebuilding of the lining takes place within the furnace in order to resume operation. The requirement for the cooling of the furnace, and the fact that the workmen must enter the cooled furnace to remove the lining, is both time consuming, dirty and hazardous, yet an improved manner for replacing furnace lining has, heretofore, not been provided.

The use of pivot pins to support the base of electric furnaces is well known as shown in U.S. Pat. Nos. 2,355,095 and 2,472,954. Likewise, the pivotal mounting of electric furnace bases on arcuate segments, either smooth or geared, is known as typically illustrated in U.S. Pat. Nos. 1,304,350 and 3,684,261. Further, the removal of portions of an electric arc furnace, such as the shell, is known as shown in U.S. Pat.. Nos. 1,445,860 and 3,723,631. With respect to the removal of the shell, in U.S. Pat. No. 1,445,860 the shell casing and the refractory lining are removed as a unit, while in U.S. Pat. No. 3,723,631 the shell is removed and the furnace construction permits the substitution of one refractory skull for another. However, the aforementioned prior art patents do not present solutions to the problem of replacing the refractory lining of arc furnaces in a practical manner achievable with available equipment and the time consuming expense of periodically replacing furnace refractory lining, particularly shell lining, continues to add significantly to the cost of producing steel by known direct arc electric furnace apparatus.

In. U.S. Pat. No. 1,445,860 replacement of the shell refractory lining is achieved in its entirety whereby one entire shell may be substituted for a deteriorated lining and shell. While such an arrangement would provide short furnace down time and rapid shell refractory lining replacement, difficulty in maintaining the refractory lining in proper relationship during handling, and storage limitations, as well as weakness at the joint lines produced between the hearth and shell lining have prevented the apparatus disclosed in this patent from being acceptable and practical.

The removal of refractory lining from the hearth of an electric furnace is particularly difficult in that such lining is not removed as often as the shell lining, and the lining often consists of a homogeneous material which has hardened requiring the use of pneumatic hammers and other power equipment to break the hearth lining to permit removal by manually "digging out" the lining.

SUMMARY OF THE INVENTION

It is an object of the invention to provide a method and apparatus for readily removing the refractory lining material within the shell and hearth of a direct arc electric furnace. In the practice of the invention the furnace need not be cooled to the extent required by the prior art and the shell lining may be quickly removed from the furnace with a minimum of manual labor and dumped into the pit for removal by power loaders.

In the practice of the invention the electric arc furnace includes a platform and base which rocks upon arcuate gear segments to produce furnace tilting for the purpose of pouring the molten metal from the furnace pouring spout. The furnace hearth constitutes a member mounted upon, but separate from, the base and pivotally mounted upon the base pivotal in a plane coincident to the tilting plane of the base and furnace during pouring. The pivotal mounting of the hearth upon the base is adjacent one side thereof, adjacent the furnace pouring spout, and the hearth may be tilted by an overhead crane at a steep angle relative to the horizontal.

In the practice of the invention the shell refractory lining material rests upon the rim of the hearth lining and is surrounded by an annular steel outer shell removably attached to the hearth. The shell refractory lining is not mechanically connected to the shell and, when the shell lining has deteriorated to the point requiring replacement, the shell is lifted from the hearth exposing the shell lining.

The exposed shell lining is collapsed into the horizontally disposed hearth by means of a cable tensioned by the overhead crane. As it is not necessary for the furnace refractory lining to be completely cooled prior to collapsing into the hearth, such collapsing may occur in a relatively short time after the furnace has been emptied.

A cable is then attached to the opposite side of the hearth with respect to its pivotal mounting to the base and the furnace hearth is tilted about its pivot and with respect to the furnace platform and base in the pouring plane of the hearth to a sufficient angle to dump the collapsed shell lining from the hearth into the pit adjacent the furnace. The dumped lining may then be readily removed from the pit by power equipment, such as a front end loader.

After the collapsed shell lining has been dumped from the hearth, the hearth is restored to its horizontal position within the base, the shell is replaced, and the shell refractory lining is rebuilt within the shell by workmen entering the same. As the shell and shell lining have been removed the hearth cools during removal of the shell and the shell lining can be restored in a fraction of the time as compared to the restoration of shell refractory lining in a furnace wherein the shell is not removed and the lining dumped.

The pivotal mounting of the hearth upon the base is such that the hearth may be readily completely removed from the base. Thus, at those intervals wherein both the shell lining and hearth lining are to be replaced the shell lining may be collapsed into the hearth and dumped therefrom as described above. Thereupon, the overhead crane may remove the hearth from the base, and place the hearth in the furnace pit in an inverted manner. The inverting of the hearth will cause the lining thereof to fall from the hearth into the pit and the hearth may then be lifted, reinverted and restored to its normal position on the base. The refractory material for the hearth may now be reinstalled and after this lining procedure has been completed the new shell lining may be placed upon the hearth lining rim after remounting the shell to the hearth.

From the above, it will be appreciated that the fact that the hearth is pivotally mounted upon the base, and completely removable therefrom, permits a replacement of the refractory lining in a manner not heretofore possible with available furnace constructions, and the improved method and apparatus in accord with the invention substantially reduce the cost of replacing refractory lining in direct arc electric furnaces as compared with known techniques.

BRIEF DESCRIPTION OF THE DRAWINGS

The aforementioned objects and advantages of the invention will be appreciated from the following description and accompanying drawings wherein:

FIG. 3 is an elevational view, partially in section, illustrating the removal of the shell, and prior to collapsing of the shell refractory material, a hearth being shown in an inverted position in the pit of FIG. 3, for purpose of illustration.

DESCRIPTION OF THE PREFERRED EMBODIMENT

Figure 1:
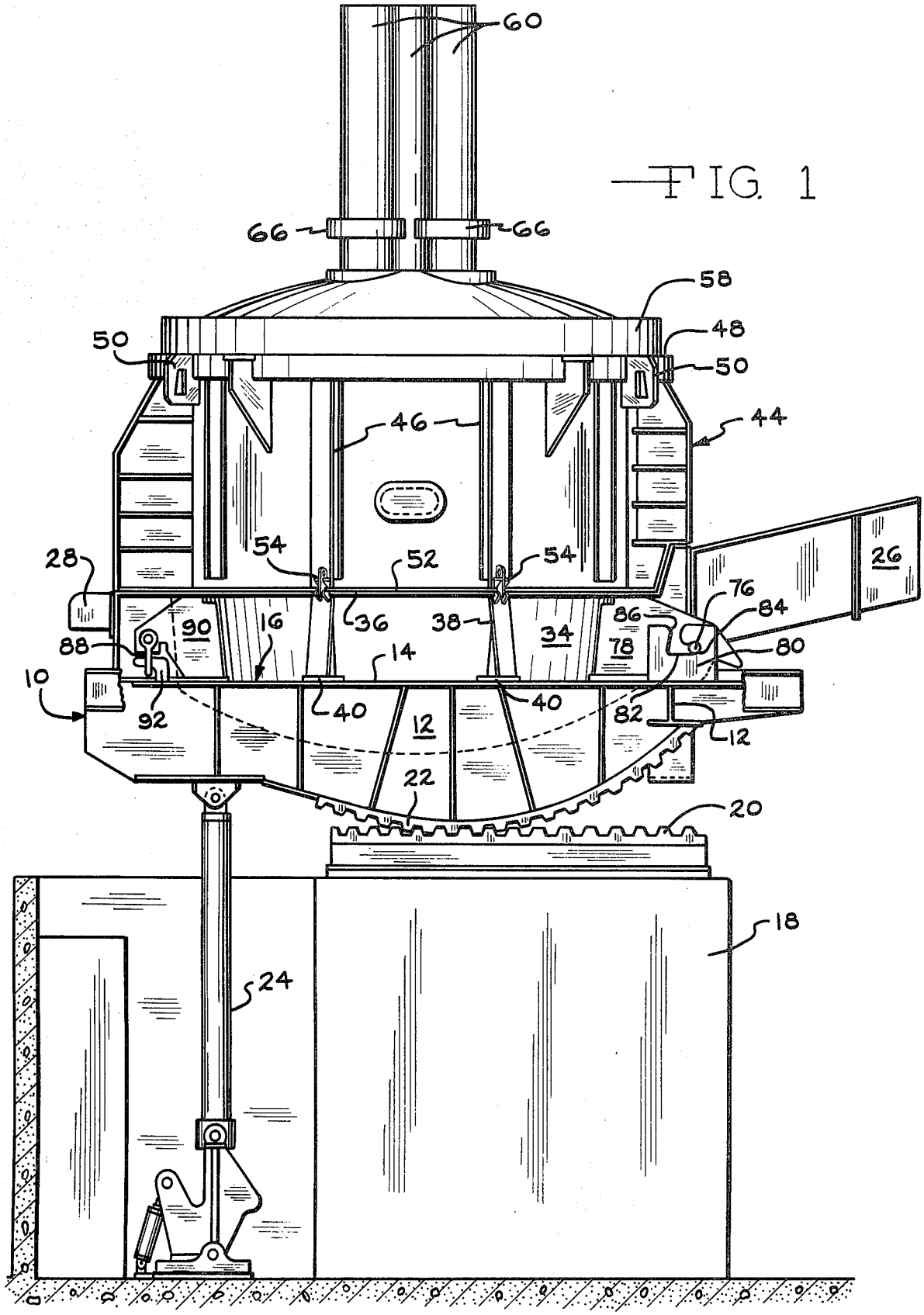
FIG. 1 is a side elevational view of an arc furnace in accord with the invention illustrating the components in the normal horizontal operating orientation.
Figure 2:
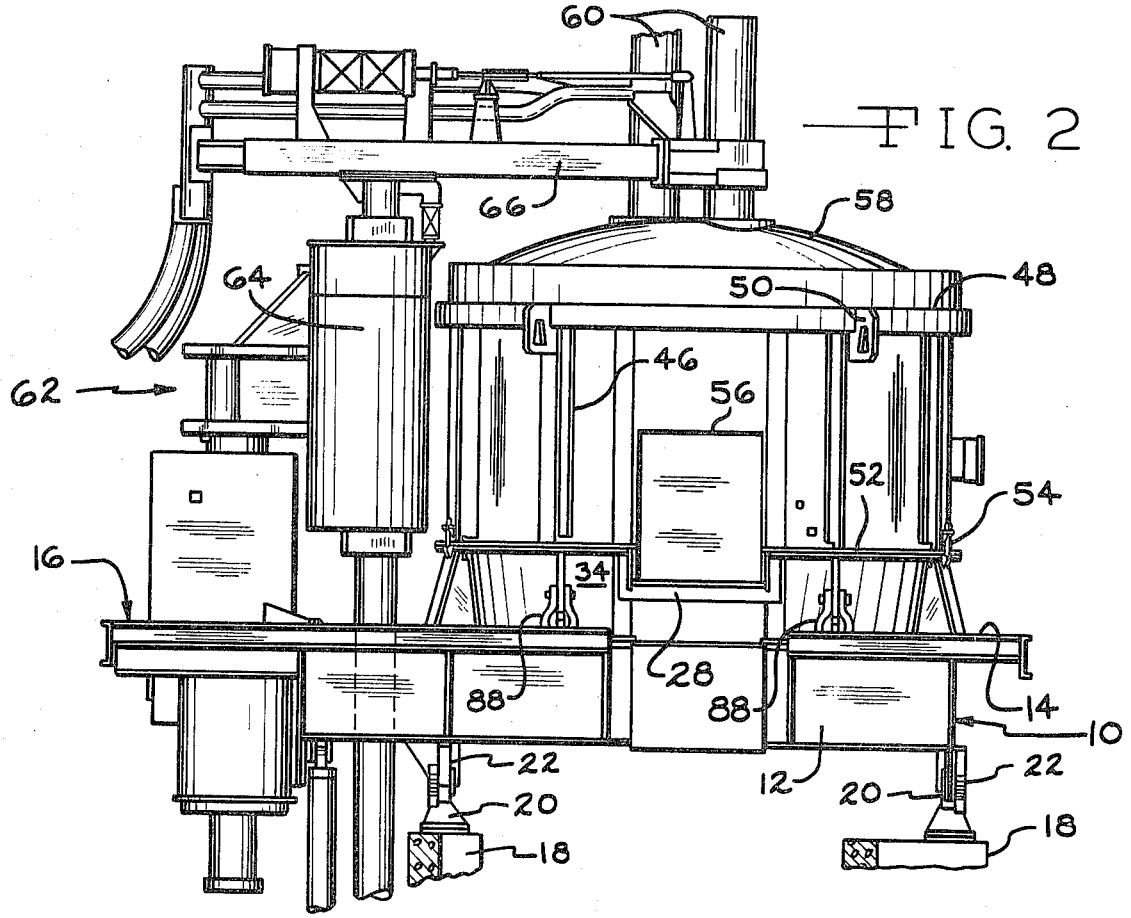
FIG. 2 is an elevational view of the furnace of the invention, as taken from the left of FIG. 1, the substructure not being fully illustrated.

A direct arc electric furnace utilizing the concepts of the invention is shown in its fully assembled relationship in FIGS. 1 and 2. The furnace includes a base 10 formed of heavy support beams 12 which support a deck 14, the base and deck constituting a platform 16 which is tilted in its entirety to permit pouring of the furnace. The base 10 is supported upon concrete pedestals 18 which each include, at their upper end, a toothed linear guide rack 20. A pair of arcuate segments formed on the base beams 12 each include a convex toothed segment 22 which engages a rack 20 and the left end of the entire base and platform, FIG. 1, may be raised or lowered by the hydraulic cylinders 24, FIG. 1, to tilt the base to permit pouring of the molten metal within the furnace from the pouring spout 26, or pouring of the slag from the slag spout 28.

A hearth 30 is pivotally supported upon the base 10, and is removable therefrom, as will be later described. The hearth 30 is formed of steel and is of a circular, shallow-dished configuration having a concave lower portion 32 and a wall 34 which includes a circumferential upper rim 36. The wall 34 slightly converges downwardly and the exterior of the wall is provided with reinforcement beams 38 having hearth support pads 40 defined on lower end thereof. The pads 40 engage beams 12 adjacent deck 14 and thereby support the hearth on the base 10.

The pouring spout 26 and slag spout 28 form a part of the hearth and extend therefrom at diametrically opposed locations. Box beams 42 are affixed to the hearth under the spouts and also rest upon the base beams 12, FIG. 5.

The portion of the furnace extending vertically above the hearth constitutes a shell 44 of steel which is of a generally cylindrical construction reinforced by longitudinally extending beams 46, FIG. 1. Preferably, the wall of shell 44 is slightly conical converging upwardly. The shell is provided with an upper rim 48, and lifting eyes 50 are defined adjacent the rim for cooperation with the cables of the overhead crane when it is desired to lift the shell from the hearth. The shell lower rim 52 engages the hearth rim 36 and clamps 54 connect the shell and hearth together. A slag door 56, FIG. 2, is formed in the shell and a similar pouring door, not shown, is defined in the shell at the pouring spout 26.

The top of the furnace is closed by a conventional cover 58 adapted to rest upon the shell upper rim 48. The cover is provided with openings through which the electrodes 60 extend, and cover and electrode support structure 62, mounted upon the platform 16, supports the cover and electrodes in the known manner.

The support 62 for the cover 58 and electrodes 60 is best shown in FIG. 2 and includes a column 64 mounted in the platform having horizontally disposed arms 66 which extend over the cover and support the electrodes 60 extending therethrough. Bus bars and similar associated equipment are mounted upon the arms 66, and electrode raising and lowering means, not described, extend through the column 64 for raising and lowering the arms and electrodes. The structure 62 also includes means for pivotally mounting the cover 58 for swinging the cover in a horizontal direction in order to provide access to the furnace, and permit charging the furnace, as well as permit removal of the cover when the shell is to be removed from the hearth. The cover, electrodes, supporting column and associated structutre form no part of the present invention and may be of conventional construction well known in the electric furnace art.

The hearth 30 is lined with a refractory material 68 adjacent the hearth portion 32 and wall 34. This lining material may be in the form of magnesite brick, if the furnace lining is basic, or silica brick if the furnace lining is acidic, or the like. If desired, the layer of brick adjacent the hearth portion 32 and wall 34 may be fireclay brick. A homogeneous grain refractory lining material 70 is used in the hearth over lining 68 and may be grain magnesite (basic) or ground silica ganister (acidic), or the like. The lining 70 extends along the pouring spout 26 and also extends in the opposite direction from the hearth into the slag pouroff spout 28, and refractory brick may also be used in the spouts.

The shell 44 of the furnace is lined with a refractory material 72 in brick form as is well known. In a basic lining an unburnt metal encased magnesite-chrome brick is preferably used and in an acidic furnace a silica brick may be employed. This refractory material forms a cylinder, FIGS. 3 and 4, which rests upon the upper rim of the hearth lining 70. The shell refractory lining 72 protects the shell 44 from direct engagement with the molten material within the furnace and, as this lining is exposed to the arc, furnace gases and splashing molten metal, the refractory shell lining degenerates during use at a faster rate than the hearth and cover lining requiring relatively frequent periodic replacement.

Figure 4:
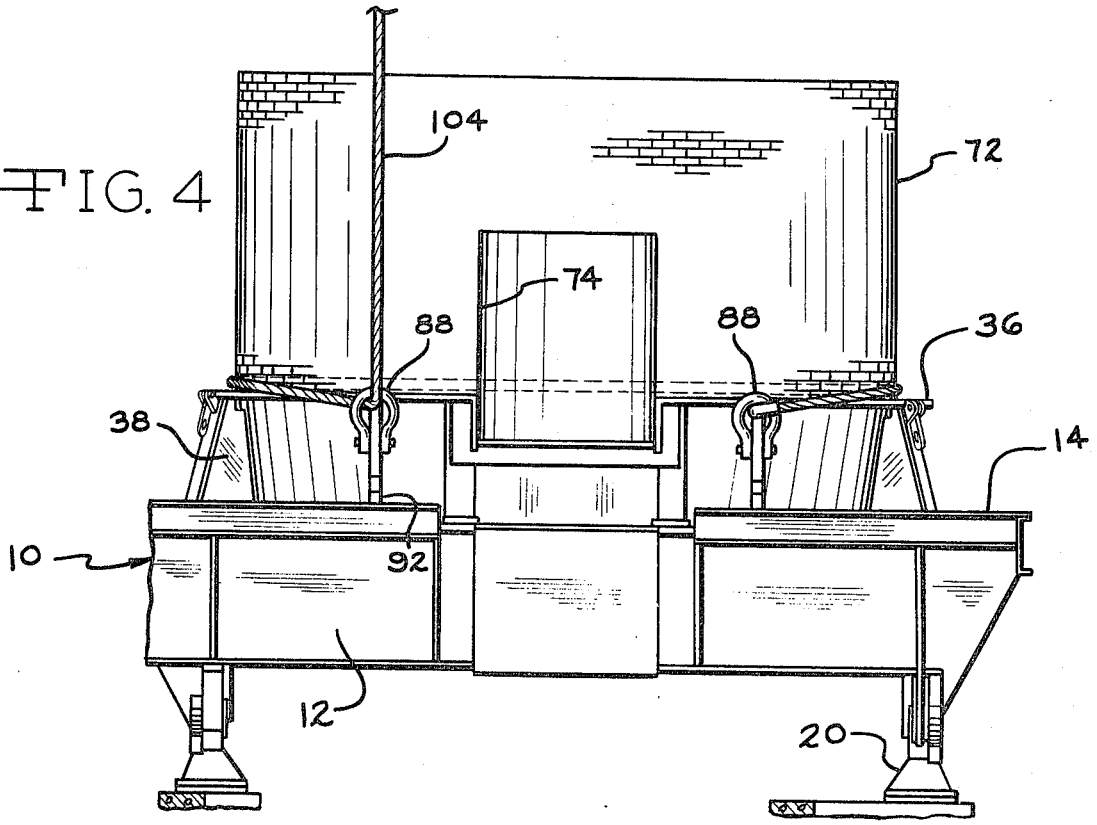
FIG. 4 is a rear elevational detail view of the furnace in accord with the invention wherein a cable has been located about the shell refractory material after removal of the shell and prior to collapsing of the refractory lining.

Openings are defined in the shell refractory lining, such as the slag door opening 74, FIG. 4, and a similar opening, not shown, is defined in the lining at the spout 26 to permit the molten material to be poured from the spout.

The hearth 30 is mounted upon the base 10 for both pivotal and removable connection therewith. This relationship is accomplished by a pair of coaxial pivot pins 76, one of which is shown in FIG. 1, mounted upon hearth plates 78 located on the hearth on each side of the spout 26. The pivot pins 76 extend in a direction at right angles to the length of the pouring spout 26 and also extend at right angles to the plane of movement of the base 10 during pouring of the furnace. The pins 76 are each received within a cradle 80 mounted upon the base 10 having an L-shaped slot 82 defined therein, FIG. 1. The slots 82 include an interlocked pivot portion 84 in which the pivot pin is illustrated as mounted and this is the hearth pivoting position of the pin within the slot. The slot is vertically open at 86 through which the pins 76 may be withdrawn from the cradle when the hearth is raised vertically after being moved to the left, FIG. 1, to remove the pin from the interlocked overlying portion 84.

The "rear" of the hearth 30 is secured to the base 10 by a pair of pivotally mounted clevises 88, FIGS. 1, 2 and 4, pivotally mounted upon the hearth plates 90. The clevises 88 may be pivoted downwardly over the hooks 92, FIG. 1, mounted upon the base 10 and, in this manner, the pivot pins 76 and the clevises 88 firmly affix the hearth to the base preventing relative displacement between the hearth and base during pivoting of the furnace during pouring.

Various known accessories are used with the furnace structure which are of conventional nature and are not illustrated. For instance, the shell 44 may include water cooled jackets and piping about the slag and pouring doors, and the conduits for this purpose are not shown.

When it is desired to replace the shell refractory lining 72 the electrodes 60 are raised sufficiently to permit the cover 58 to be removed from the top of the shell 44, in the known manner. Of course, the furnace has been previously emptied of molten metal and has begun to cool. However, in the practice of the invention it is not necessary to cool the furnace before the lining replacement procedure starts.

The lower rim 52 of the shell has been previously attached to the upper rim 36 of the hearth 30 by the clamps 54, FIG. 1, and the clamps 54 are now unloosened. The mill overhead crane 94, FIG. 3, consisting of a carriage mounted upon rails 96, as is well known, lowers the lifting cables 98, FIG. 3, for engagement with the shell eyes 50 and lifts the shell 44 directly vertically upward from the hearth 30. This upward movement of the shell may or may not disturb the shell refractory lining 72. Lining 72, when originally installd, was in direct engagement with the inner surface of the shell. However, shrinkage often occurs during use due to the heat of furnace operation, and the refractory lining may shrink and not adhere to the inner surface of the shell. If there is partial adhesion of the lining to the shell 44 during raising thereof, the upper layers of brick lining will usually be knocked toward the center of the shell and fall into the hearth and, due to the confinement of the lining by the shell, lining brick disturbed during shell lifting will fall on the hearth. If the shell has a slight conical configuration converging upwardly removal of the shell without disturbing of the lining is aided. The shell 44 is raised, as shown in FIG. 3, clear of the furnace. In the drawings, the lining 72 is illustrated as undisturbed during shell removal and in such instance the lining of the shell retains its cylindrical configuration resting upon the rim of the hearth lining. The shell 44 is transported out of alignment with the furnace and placed in the pit 102, FIG. 3, adjacent the furnace, or elsewhere.

The clevises 88 are now pivoted upwardly from under the hooks 92, as shown in FIG. 4, to disconnect the hearth from the base at the slag door side of the hearth.

The overhead crane 94 is now repositioned directly above the furnace and a cable 104 is lowered therefrom, passed through one clevis 88, FIG. 4, and around the shell lining 72 adjacent hearth rim 36 wherein the end of the cable may be attached to the other clevis 88. As will be appreciated from FIG. 4, the cable 104 is now substantially encircling all the shell refractory material.

Figure 5:
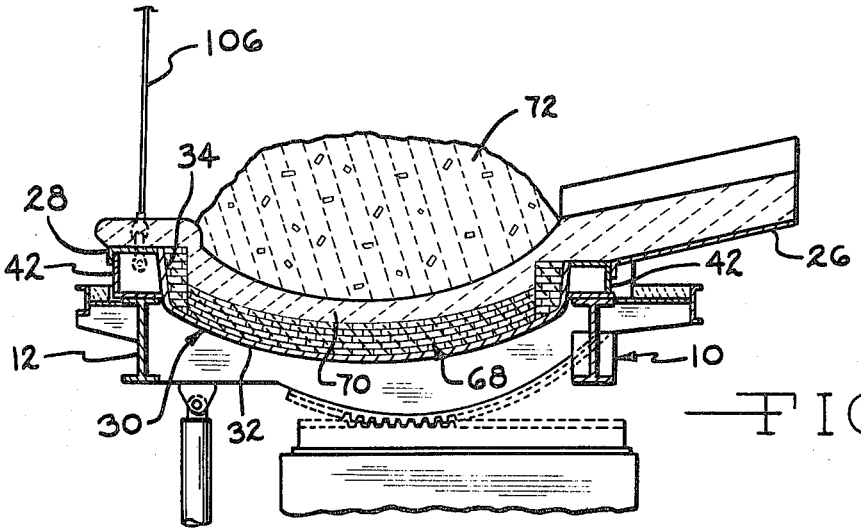
FIG. 5 is a reduced scale sectional view illustrating the accumulation of shell refractory lining in the hearth after the shell lining has been collapsed.

Tensioning of the cable 104 by the overhead crane draws the cable inwardly causing the shell refractory lining 72 to "cave" into the hearth 30, as shown in FIG. 5. The bricks constituting the shell refractory lining will fall into the center of the hearth, as shown in FIG. 5, and any remaining debris of the shell lining may be shoveled or pushed into the hearth from the hearth lining rim. It will be understood that the tension on cable 104 required is not sufficient to lift the hearth at hooks 92.

Figure 6:
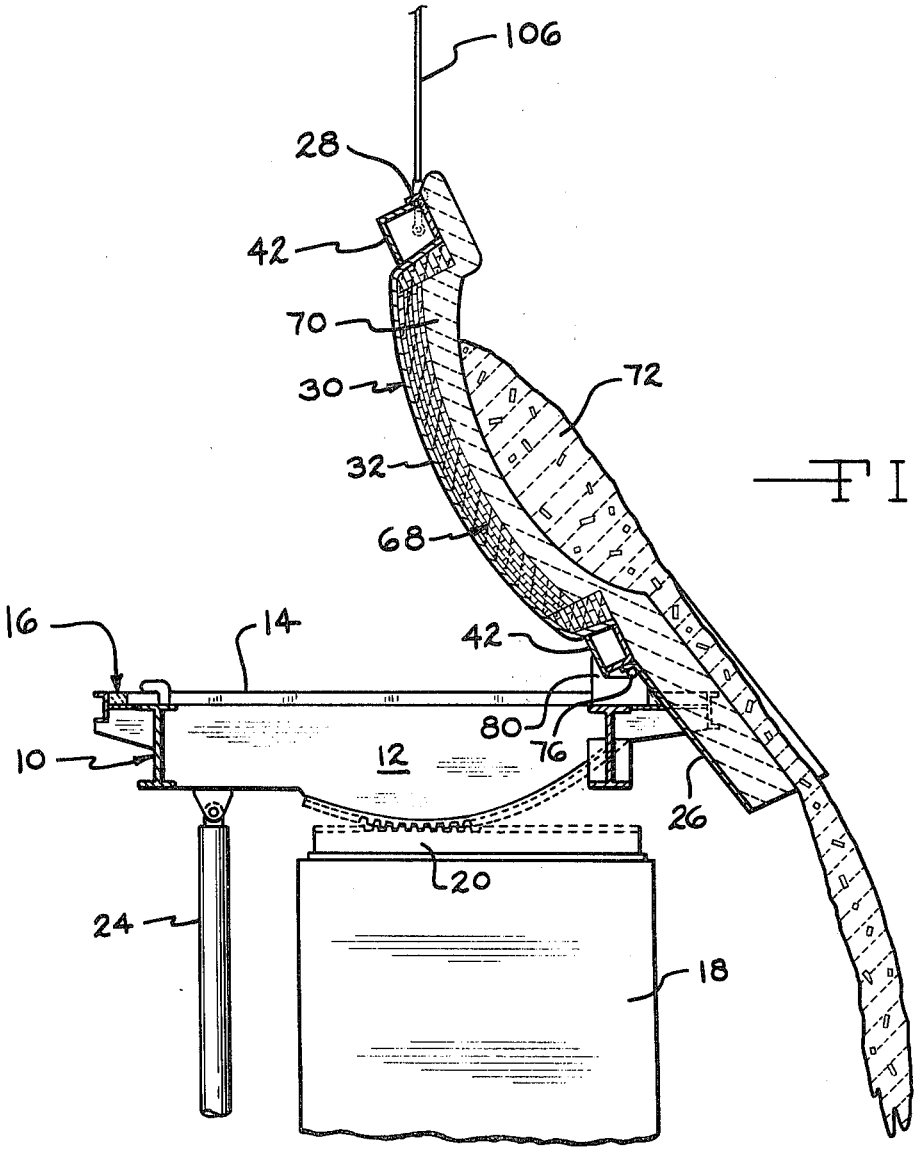
FIG. 6 illustrates the orientation of the hearth relative to the base during dumping of the shell refractory lining therefrom.

A pair of cables 106, one of which is shown in FIGS. 5 and 6, extend from the overhead crane 94 attached to the clevises 88. As the clevises 88 have previously been removed from the hooks 92, tensioning of the cables 106 lifts the left side of the hearth 30, FIG. 5, and pivots the hearth about the pivot pins 76, FIG. 6. The hearth is raised to a steep angle, in the neighborhood of 70°, sufficient to dump the collapsed shell refractory lining 72 from the hearth into the furnace pit 102, as shown in FIG. 6. It will be appreciated that during this time the base 10 is horizontal and is not tilting.

After the collapsed shell lining has been dumped from the hearth 30, the hearth is lowered to its horizontal position where pads 40 engage base 10, and the clevises 88 are placed about the hooks 92 to affix the hearth to the base. The shell 44 is then retrieved by the crane 94 and lowered upon the hearth rim 36 and affixed thereto by restoring the clamps 54. The workmen now enter the furnace upon a platform lowered into the shell and a new lining 72 is installed within the shell in the conventional manner wherein the shell lining is built up on the rim of the hearth lining even with the upper rim 48 of the shell. Upon completion of the installation of the shell lining the furnace is now ready for use, the furnace is charged, the cover 58 and electrodes 60 replaced, the electrodes ignited, and melting is resumed.

The aforementioned sequence of steps to permit the shell refractory lining 72 to be quickly removed from the hearth significantly reduces the "down" time of the furnace for the replacement of the shell lining by 50% to 80% as compared with conventional shell lining replacement techniques, and significant savings in time, manpower and money have been experienced in the practice of the aforementioned steps of shell refractory lining replacement as well as reducing the safety hazards attendant with shell lining replacement.

The refractory lining within the hearth 30 requires replacement only about a tenth as often, or less, as the shell refractory lining, and when it is desired to replace the hearth refractory lining 68 four overhead crane cables are attached to the hearth after the shell refractory lining has been dumped therefrom. The hearth, at this time, will be in a horizontal position, as in FIG. 5, and the hearth is slightly raised and moved to the left, FIG. 5, sufficiently to align the pivot pins 76 with the cradle slot portion 86. The hearth 30 is then lifted completely free of the base 10 and is transported to the pit 102 and inverted, as shown at the lower right in FIG. 3. Inversion of the hearth will usually cause the lining 68 to fall therefrom and vibration upon the hearth, as by hammers, or the like, will cause that lining which may adhere to the hearth to fall to the floor of the pit. After the lining has been completely removed from the hearth, and the associated pouring and slag spouts 26 and 28, the hearth is lifted, reinverted, and restored upon the base 10 with the pivot pins 76 in the cradles 80 and the clevises 88 are pivoted over the hooks 92 connecting the hearth to the base. Thereupon, the hearth refractory lining 68 is installed and, after this procedure is completed, the shell refractory lining 72 is installed after the shell 44 is repositioned upon the hearth and clamped thereto.

It will be appreciated that the fact that the hearth 30 is pivotal with respect to the base 10, and may be completely removed therefrom, permits a versatility of furnace operation for the purpose of removing refractory linings not heretofore possible and the advantages of the features of the invention significantly reduce the cost attendant with the operation of direct arc electric furnaces.

It will be understood that modifications to the inventive concepts may be apparent to those skilled in the art without departing from the spirit and scope of the invention.

I claim:

1. The method of removing the refractory lining from an electric arc furnace having a base, a lined hearth pivotally mounted about a substantially horizontal axis with respect to the base and removable from the base, a shell lining supported upon the hearth and a shell mounted upon the hearth encompassing the shell lining comprising steps of removing the shell from the hearth wherein the shell lining is exposed and unsupported, collapsing the shell lining into the hearth, and pivoting the hearth about its pivot axis relative to the base to dump the collapsed lining therefrom.

2. The method of removing refractory lining from an electric arc furnace as in claim 1 wherein the step of collapsing the shell lining into the hearth comprises circumscribing the shell lining with a flexible cable and tensioning the cable to pull the shell lining inwardly.

3. The method of removing refractory lining from an electric arc furnace as in claim 1 comprising the additional steps of removing the hearth from the base, inverting the hearth upon a supporting surface, and removing the lining from the hearth by gravity whereby the hearth lining falls upon the supporting surface.

4. An electric arc furnace comprising, in combination, a base, means tiltably supporting said base for tilting in a given direction, means for tilting said base, a hearth having a pouring spout, pivot means pivotally mounting said hearth upon said base for pivotal movement relative thereto about a substantially horizontal axis, an annular shell mounted upon said hearth, releasable holding means mounting said shell upon said hearth permitting said shell to be removed from said hearth, refractory lining within said hearth, wall refractory lining supported upon said hearth and located within said shell, a cover disposed over said shell, means for removing said cover from said shell, and electrode means associated with said cover for extending through said cover into the furnace.

5. In an electric arc furnace as in claim 4 wherein said pivot means includes pivot releasing means whereby said hearth may be removed from said base.

6. In an electric arc furnace as in claim 4 wherein said base tilts in the direction the spout extends from said hearth, said pivot means pivotally mounting said hearth having an axis substantially perpendicular to the plane of tilting movement of said base.

7. In a direct arc electric furnace having a base, means for tilting said base, a hearth defined upon said base, a pouring spout extending from said hearth, an annular shell extending from the hearth and removable therefrom, refractory lining within the hearth and shell, a removable cover adapted to be disposed over the shell, and electrodes adapted to extend through the cover, the improvement comprising said hearth being formed as a separate member with respect to said base and releasable pivot means connecting said hearth to said base, said pivot means pivotally mounting said hearth upon said base for pivotal movement thereon about a substantially horizontal pivot axis and permitting said hearth to be lifted from and removed from said base.

8. In a direct arc electric furnace as in claim 7 wherein said pivot means includes a pivot pin received within a pivot cradle, and a slot defined in said cradle receiving said pivot pin permitting said pin to be removed from said cradle upon said hearth being vertically displaced relative to said base.

9. In a direct arc electric furnace having a base, means for tilting said base, a hearth defined upon said base, a pouring spout extending from said hearth, an annular shell extending from the hearth and removable therefrom, refractory lining within the hearth and shell, a removable cover adapted to be disposed over the shell, and electrodes adapted to extend through the cover, the improvement comprising, said hearth constituting a separate member with respect to said base, and pivot means disposed adjacent said spout pivotally mounting said hearth upon said base for pivotal movement thereto about a substantially horizontal axis disposed perpendicular to the direction of tilting of said base.

10. In a direct arc electric furnace as in claim 9 wherein said pivot means includes a pivot pin defined on said hearth, a pivot cradle mounted upon said base, and a vertically extending slot defined in said cradle receiving said pivot pin, said pivot pin being removable from said cradle through said slot permitting said hearth to be removed from said base.

11. In a direct arc electric furnace as in claim 10, a pivot pin bracket defined on said hearth on each horizontal side of said spout, a pivot pin mounted within each bracket and a cradle mounted upon said base on each horizontal side of said spout receiving a pivot pin.

12. In a direct arc electric furnace as in claim 10, releasable hearth retaining means interposed between said hearth and said base on the opposite side of said hearth with respect to said pivot pin and cradle.

* * * * *